US006883485B2

(12) United States Patent
Fukuzawa et al.

(10) Patent No.: US 6,883,485 B2
(45) Date of Patent: Apr. 26, 2005

(54) OHV AND GEAR MECHANISM FOR ENGINE

(75) Inventors: Kazuto Fukuzawa, Saitama (JP); Tomomi Ishikawa, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 13 days.

(21) Appl. No.: 10/302,982

(22) Filed: Nov. 25, 2002

(65) Prior Publication Data

US 2003/0177994 A1 Sep. 25, 2003

(30) Foreign Application Priority Data

Dec. 7, 2001 (JP) ..... 2001-374483
Dec. 7, 2001 (JP) ..... 2001-374484

(51) Int. Cl.[7] ..... F01L 1/14

(52) U.S. Cl. ..... 123/90.61; 123/90.39; 123/90.4; 123/90.44; 123/198 F

(58) Field of Search ..... 123/90.39, 90.4, 123/90.44, 90.61, 198 F, 195 C, 198 E, 198 P, 90.41, 193.5, 193.3, 193.4, 193.2

(56) References Cited

U.S. PATENT DOCUMENTS

| | | | | |
|---|---|---|---|---|
| 1,524,150 A | | 1/1925 | Rhoads | |
| 3,968,485 A | | 7/1976 | DeHart | |
| 4,425,881 A | * | 1/1984 | Lyndhurst | 123/184.34 |
| 6,098,582 A | * | 8/2000 | Araki | 123/90.31 |
| 6,349,688 B1 | * | 2/2002 | Gracyalny et al. | 123/90.39 |
| 6,634,330 B1 | * | 10/2003 | Matsuda et al. | 123/90.39 |

FOREIGN PATENT DOCUMENTS

| | | | | |
|---|---|---|---|---|
| EP | 260172 A | | 7/1949 | |
| EP | 123063 A2 | * | 10/1984 | F01L/1/46 |
| EP | 1 050 668 A1 | | 11/2000 | |
| EP | 1 207 274 A2 | | 5/2002 | |
| JP | 62-90905 U | | 6/1987 | |
| JP | 64-36654 U | | 3/1989 | |
| JP | 8-226310 A | | 9/1996 | |

OTHER PUBLICATIONS

Patent Abstracts of Japan, vol. 9, No. 077 (M–369), Apr. 6, 1985, Japanese Publication No. 59–208109 (Nov. 26, 1984), "Tappet Valve Device of Horizontally Opposed Engine," S. Masuhiro.

(Continued)

*Primary Examiner*—Thomas Denion
*Assistant Examiner*—Ching Chang
(74) *Attorney, Agent, or Firm*—Birch, Stewart, Kolasch & Birch, LLP

(57) ABSTRACT

In an OHV engine in which a pair of cylinder blocks is connected to the crankcase and power from a cam is transmitted to a rocker arm pivotably supported by the cylinder heads via connecting rods, to enable downsizing of the engine while reducing the number of components and the number of assembling steps. A part of the connecting rods out of the respective connecting rods are respectively stored in a rod storage chamber provided in both cylinder heads, both cylinder blocks and a crankcase between the cylinder axes of the adjacent cylinder bores in the respective cylinder blocks. The remaining connecting rod disposed outwardly of the cylinder axes of the outermost cylinder bores laid along the axis of the crankshaft is stored in part in a pipe member disposed at the position away from the outer walls of the cylinder blocks. In addition, the supporting shaft on the engine body is inserted into and supported by a plurality of shaft supporting members provided in the engine body and the arms are pivotably supported by the supporting shaft.

12 Claims, 9 Drawing Sheets

OTHER PUBLICATIONS

Patent Abstracts of Japan, vol. 6, No. 204 (M–164), Oct. 15, 1982, Japanese Publication No. 57–110707 (Jul. 9, 1982), "Push Rod for Valve Mechanism of Internal Combustion Engine," H. Yoshiaki.

Patent Abstracts of Japan, vol. 1996, No. 8, Aug. 30, 1996, Japanese Publication No. 08–093422 (Apr. 9, 1996), "Valve System of Overhead Valve Type Internal Combustion Engine," M. Minoru.

Patent Abstract of Japan, Publ. No. 05321804A, Dec. 7, 1993, "Controller for Engine With Turbo–Supercharger," Mitsuo Hitomi et al.

Patent Abstracts of Japan, vol. 015, No. 505 (M–1194), Dec. 20, 1991 & JP 03–222804–A, Suzuki Motor Corp., Hiroyasu YADA, Oct. 1, 1991.

* cited by examiner

OHV AND GEAR MECHANISM FOR ENGINE

CROSS-REFERENCE TO RELATED APPLICATIONS

The present nonprovisional application claims priority under 35 USC 119 to Japanese Patent Application Nos. 2001-374484 and 2001-374483 both filed on Dec. 7, 2001 the entire contents thereof is hereby incorporated by reference.

BACKGROUND OF THE INVENTION

1. Field of the Invention

The present invention relates to an improved OHV engine in which a pair of cylinder blocks provided with a plurality of cylinder bores is connected to the crankcase. Power from a cam provided on a camshaft interlocked with and connected to a crankshaft and stored in the crankcase is transmitted to rocker arms pivotably supported on cylinder heads connected. respectively. to both of the aforementioned cylinder blocks via connecting rods.

The present invention also relates to a valve gear mechanism of an engine in which a supporting shaft having both ends thereof facing towards the wall provided by the engine body is inserted into and supported by shaft supporting members provided in the aforementioned engine body at a plurality of positions spaced axially of the supporting shaft. A plurality of arms are pivotably supported by the supporting shafts. More specifically, the invention relates to an improved arm supporting structure.

2. Description of the Background Art

Hithertofore, an OHV engine is known wherein cams are provided on a camshaft in a crankcase and rocker arms on the cylinder head sides are interlocked and connected via a connecting rod as set forth in JP-U-64-36654.

In such OHV engines, it is already known to provide an engine wherein each connecting rod being stored in part in a pipe member disposed at a position away from an outer wall of the cylinder blocks so as to connect between the crankcase and the cylinder heads for allowing smooth movement of the plurality of connecting rods without interference from the outside.

However, when employing the structure in which a pipe member is disposed for each connecting rod for a V-type or a horizontal opposed engine having a pair of cylinder blocks on which a plurality of cylinder bores are disposed adjacent to each other in the direction of the axis of the crankshaft, the arrangement of a connecting boss for pipe members may be limited and thus the distance between cylinder bores cannot be reduced easily when downsizing the engine by minimizing the distance between the cylinder bores. In addition, the number of pipe members increases, and thus the number of components increase and the number of assembling steps increases as well.

In order to solve such a problem, it is conceivable to store all the connecting rods in a rod storage chamber provided in the cylinder heads, the cylinder blocks, and the crankcase between the adjacent cylinder bores on the respective cylinder blocks. However, the number of connecting rods that can be arranged between the adjacent cylinder bores is limited in the case of reducing the distance between the adjacent cylinder bores.

Hithertofore, as disclosed in JP-A-8-226310, a valve gear mechanism is known wherein a rocker shaft that corre sponds to a supporting shaft is inserted into and supported by a plurality of shaft supporting members provided integrally on the cylinder head, and a rocker arm is pivotably supported by the rocker shaft.

However, in the aforementioned related art, the rocker shaft is formed integrally along the whole axial length. When the sidewall of the cylinder head faces towards the end of the rocker shaft, an opening for inserting the rocker shaft is formed on the sidewall in advance, and then a member for closing the aforementioned opening is attached after insertion of the rocker shaft during assembly of the valve gear mechanism. Therefore, an extra part is required, as well as the number of assembling steps increases. In this case, though employing a structure in which each shaft supporting member may be divided into an upper part and the lower part may solve the aforementioned problem, the costs may be increased.

SUMMARY AND OBJECTS OF THE INVENTION

With such circumstance in view, it is a first object of the present invention to provide an OHV engine that can be downsized while reducing the number of components and the number of assembling steps.

In the related art, the pipe member is disposed between the cylinder heads and the crankcase when storing the connecting rods in part in the pipe member. Therefore, stress may be applied on the pipe member due to the assembling error of the cylinder heads and the crankcase, which may result in uncertain sealing between the pipe member and the cylinder heads and the crankcase.

With such circumstance in view, it is a second object of the present invention to provide an OHV engine that ensures sealing at both ends of the pipe member.

In order to achieve the first object, the present invention includes an OHV engine in which a pair of cylinder blocks each having a plurality of cylinder bores is connected to a crankcase with cylinder axes of the aforementioned cylinder bores displaced in the direction along the axis of the crankshaft. Connecting rods provided for transmitting power from a cam provided on a camshaft interlocked with and connected to the aforementioned crankshaft and stored in the crankcase are individually interlocked with and connected to a plurality of rocker arms pivotably supported, respectively, by the cylinder heads connected, respectively, to the aforementioned cylinder blocks. A part of the connecting rods out of the aforementioned connecting rods are stored in a rod storage chamber provided, respectively, in said cylinder heads, both cylinder blocks and the crankcase between the cylinder axes of the adjacent cylinder bores in the aforementioned respective cylinder blocks, and the remaining connecting rod disposed outwardly of the cylinder axes of the outermost cylinder bores laid along the axis of the aforementioned crankshaft is stored in part in the pipe member disposed at the position away from the outer wall of the aforementioned cylinder blocks.

According to the structure in the present invention, since as many of the connecting rods as can be disposed between the cylinder axes of the adjacent cylinder bores in both of the cylinder blocks within reason are stored in the rod storage chamber provided in both cylinder heads, both cylinder blocks, and crankcase, and the connecting rods disposed outwardly of the cylinder axes of the outermost cylinder bores along the axis of the crankshaft are stored in part in the pipe member, the number of pipe members may be reduced as much as possible and thus the number of components as well as the number of assembling steps may be reduced. In addition, the distance between the adjacent cylinder bores may be reduced to a reasonable extent to contribute to the downsizing of the engine.

In the present invention, both ends of the pipe member for storing the aforementioned remaining connecting rods in part are connected to the first communication chamber formed from the cylinder heads to the upper portion of the cylinder blocks and to the second communication chamber formed in the crankcase which is integrally formed with the aforementioned cylinder blocks. In this arrangement, both ends of the pipe member are connected to the upper portion of the cylinder blocks and to the crankcase at a position that is not varied by the assembling error of the crankcase, the cylinder blocks and the cylinder heads, and thus the pipe member is prevented from being stressed by the assembling error. Thus, the seal on both ends of the pipe member is prevented from being impaired by the stress.

In order to achieve the aforementioned second object, the present invention provides an OHV engine in which the cam provided on the camshaft interlocked with and connected to the crankshaft and stored in the crankcase and the rocker arm pivotably supported by the cylinder heads are interlocked with and connected to each other via the connecting rod. The connecting rod is stored in part in the pipe member disposed between the aforementioned crankcase and the cylinder heads at a position away from the outer wall of the cylinder blocks. Both ends of the pipe member are connected to the first communication chamber formed from the cylinder heads to the upper portion of the cylinder blocks and to the second communication chamber formed in the crankcase that is formed integrally with the aforementioned cylinder blocks.

In this arrangement, both ends of the pipe member are connected to the upper portion of the cylinder blocks and to the crankcase at the position that is not varied by the assembling error of the crankcase, the cylinder blocks and the cylinder heads. Thus, the pipe member is prevented from being stressed by the assembling error, and sealing on both ends of the pipe member is prevented from being impaired by the stress.

With such circumstances in view, it is an object of the present invention to provide an arm supporting structure in a valve gear mechanism of engine in which a supporting shaft may be mounted on the engine body without increasing the costs, and with a reduction in the number of components and assembling steps.

In order to achieve the aforementioned object, the present invention provides a valve gear mechanism of an engine in which supporting shafts having both ends thereof facing towards a wall provided by the engine body are inserted into and supported by shaft supporting members provided on the aforementioned engine body at a plurality of positions spaced axially of the supporting shafts. A plurality of arms are pivotably supported by the supporting shafts. The aforementioned supporting shafts include a plurality of shaft sections divided into sections shorter than the distance between at least one of the pairs of shaft supporting members facing towards the aforementioned sidewall out of the aforementioned plurality of shaft supporting members, and are inserted into and supported by at least one of the aforementioned plurality of shaft supporting members respectively and axially abutted against each other.

According to such a structure, since the supporting shaft may be constructed by inserting a plurality of shaft sections into the respective shaft supporting members in sequence without forming an opening on the wall of the engine body, and abutting the shaft sections against each other, it is not necessary to employ a structure in which each shaft supporting member is divided into an upper portion and a lower portion, and thus an increase in the costs may be avoided. In addition, it is not necessary to form an opening on the wall. Thus, a member for closing the opening is not necessary and the number of components and the number of assembling steps may be reduced correspondingly when the supporting shafts are mounted on the engine body.

According to the present invention, the shaft sections located at both ends out of the plurality of aforementioned shaft sections are attached with movement preventing members for engaging the shaft supporting member for inserting and supporting the shaft section at both ends thereof and preventing the axially outward movement of the aforementioned shaft sections at both ends. In this arrangement, the coaxial connecting structure of all the shaft sections may be maintained only by mounting the movement preventing members on a pair of shaft sections. Thus, the number of components for fixedly supporting the supporting shaft on the engine body may be reduced.

According to the present invention, the aforementioned movement preventing members are retaining rings to be detachably mounted on the aforementioned shaft sections at both ends. In this arrangement, the structure of the shaft supporting member may be simplified, and the machining operation applied on the shaft sections may be facilitated.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

An embodiment of the present invention will now be described based on an embodiment of the present invention shown in the attached drawings. FIG. 1 to FIG. 9 show an embodiment of the present invention.

Figure 1:
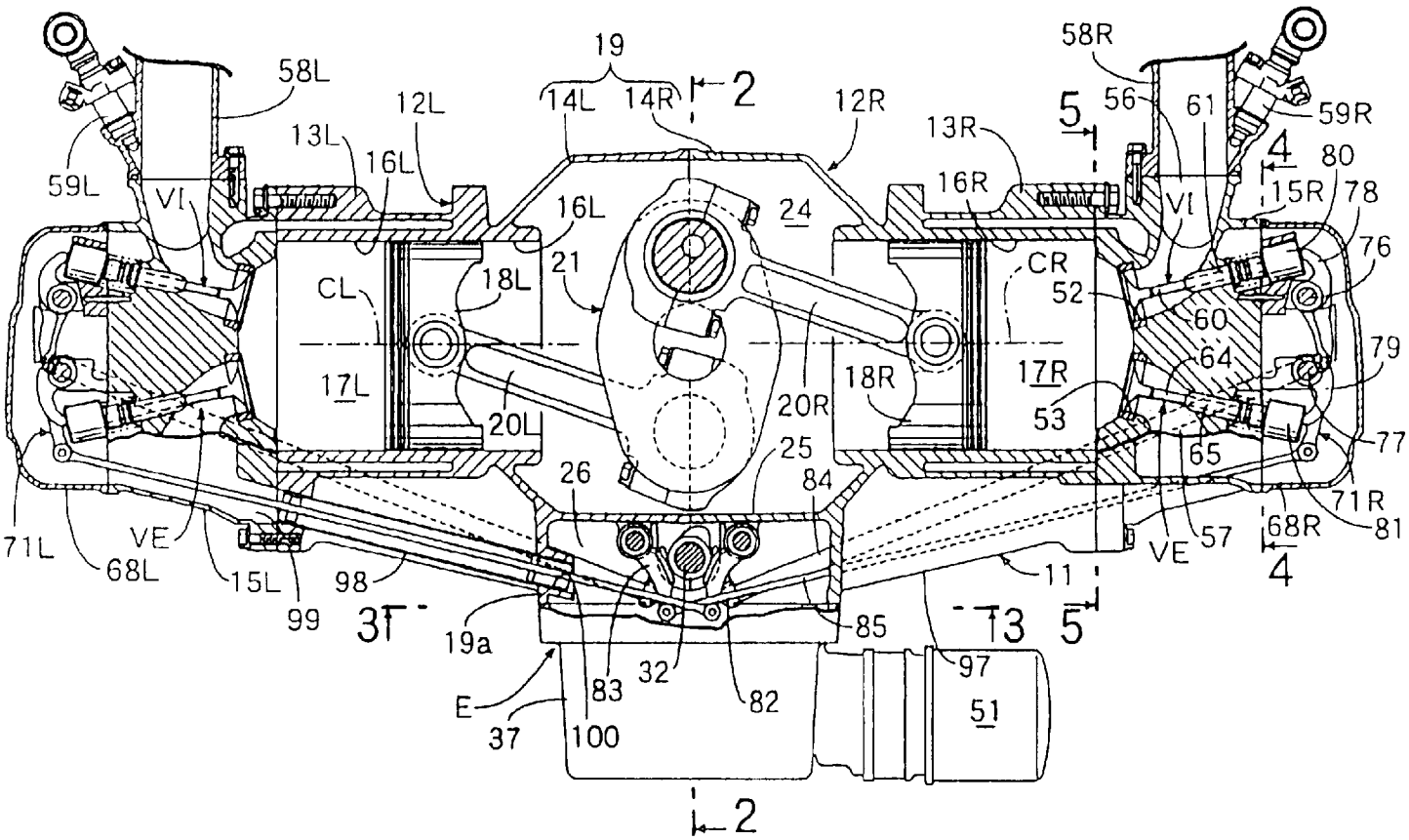
FIG. 1 is a vertical cross-sectional back view of the OHV engine when seen from behind.

In FIG. 1, a four-cylinder OHV engine E, which is, for example, a horizontal opposed type adapted to be mounted, for example, on an aircraft. An engine body 11 of the engine E includes a left engine block 12L disposed on the left side when the engine E is viewed from behind and a right engine block 12R to be disposed on the right side when the engine E is viewed from behind.

The left engine block 12L includes a left cylinder block 13L, a left crankcase 14L to be formed integrally with the left cylinder block 13L and a left cylinder head 15L to be connected to the left cylinder block 13L on the opposite side of the left crankcase 14L. The right engine block 12R includes a right cylinder block 13R, a right crankcase 14R formed integrally with the right cylinder block 13R, and a right cylinder head 15R to be connected to the right cylinder block 13R on the opposite side of the right crankcase 14R.

The both cylinder blocks 13L, 13R are provided with pairs of cylinder bores 16L . . . , 16R . . . , respectively, and pistons 18L . . . , 18R . . . are slidably fitted into the cylinder bores 16L . . . , 16R . . . so as to define combustion chambers 17L . . . , 17R . . . between the respective cylinder heads 15L, 15R.

Both of the engine blocks 12L, 12R are positioned so as to face with respect to each other with the cylinder axes CL . . . ,CR . . . of the cylinder bores 16L . . . , 16R . . . oriented substantially horizontally. The left and right crankcases 14L, 14R are connected with each other for cooperatively defining a crankcase 19. A crank shaft 21 to be connected to the aforementioned both pistons 18L . . . , 118R . . . via connecting rods 20L . . . , 20R, are rotatably supported between the aforementioned left and right crankcases 14L, 14R. Therefore, the cylinder axes CL of the cylinder bores 16L . . . and the cylinder axes CR . . . of the cylinder bores 16R . . . are displaced in the direction along the axis of the crankshaft 21.

Figure 2:
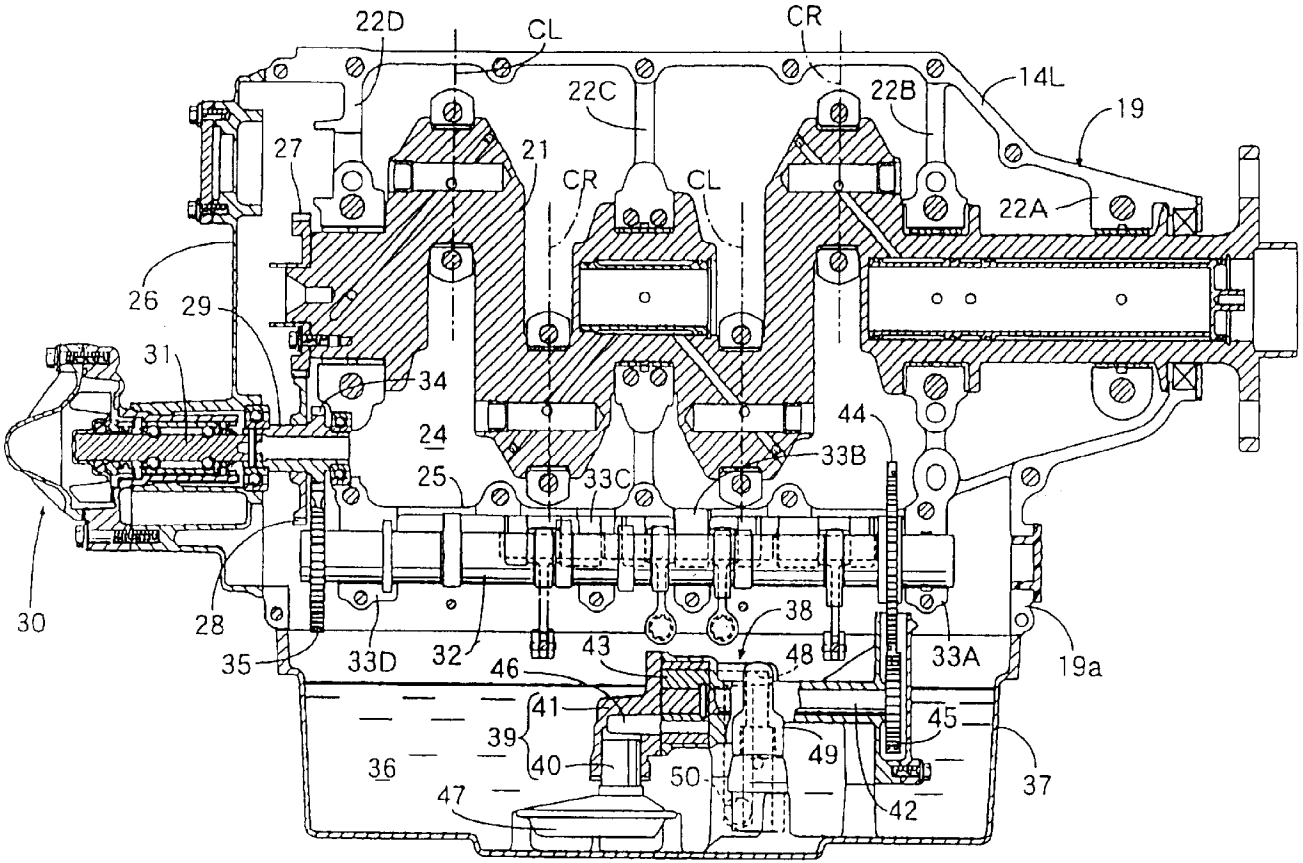
FIG. 2 is a cross-sectional view taken along the line 2—2 in FIG. 1.

In FIG. 2, the crankcase 19 is integrally provided with first to fourth journal walls 22A–22D lined up from the front to the rear thereof apart from each other and formed by the cooperation of the left and right crankcases 14L, 14R. The crankshaft 21 is rotatably supported by the first to fourth journal walls 22A–22D at axially spaced four positions. The crankshaft 21 is to be stored in a crank chamber 24 formed in the crankcase 19. A partition wall 25 for defining the bottom of the crank chamber 24 is provided in the crankcase 19.

The rear end (left end in FIG. 2) of the crankshaft 21 projects rearwardly from the aforementioned fourth journal wall 22D. A cover 26 for covering the rear end of the crankshaft 21 is connected to the rear portion of the crankcase 19. A drive gear 27 is secured on the crankshaft 21 between the fourth journal wall 22D and the cover 26 with a driven gear 28 to engage the drive gear 27 being secured on a revolving shaft 29.

Both ends of the revolving shaft 29 are rotatably supported by the cover 26 and the fourth journal wall 22D. The cover 26 is provided with a water pump 30. A pump shaft 31 of the water pump 30 is coaxially connected to the aforementioned revolving shaft 29 so as to prevent relative rotation. Thus, rotational power from the crankshaft 21 is transmitted also to the water pump 30.

Figure 3:
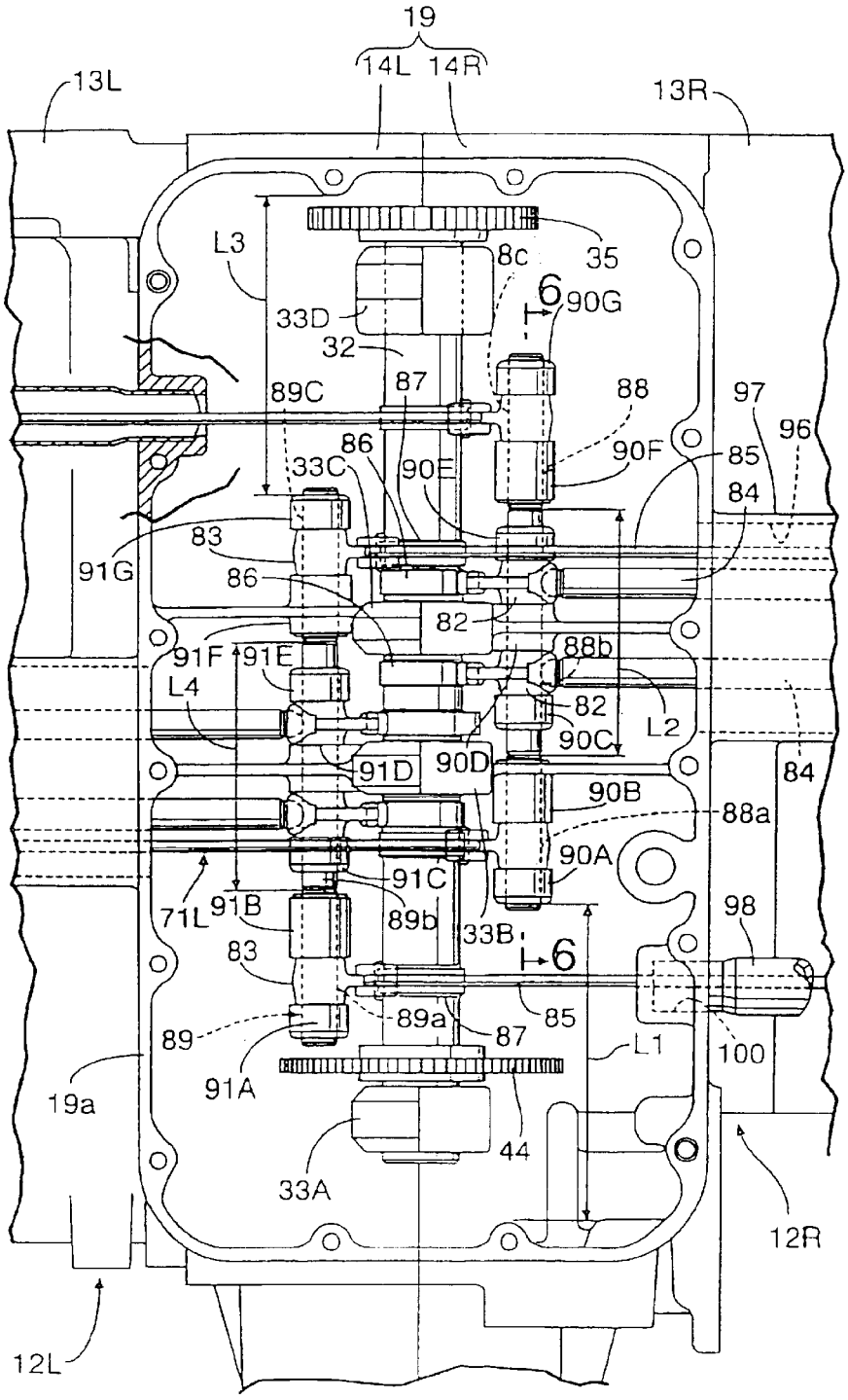
FIG. 3 is a view seen in the direction indicated by the arrows 3—3 in FIG. 1 in a state in which an oil pan is removed.

Referring also to FIG. 3, a camshaft 32 having an axis parallel to the crankshaft 21 is disposed downwardly of the aforementioned partition wall 25. The camshaft 32 is rotatably supported by first to fourth bearings 33A–33D provided on the partition wall 25 at the positions lined up from the front to the rear apart from each other.

The first and the fourth bearings 33A, 33D are disposed at the positions corresponding to the first and the fourth journal walls 22A, 22D, and the second and the third bearings 33B, 33C are disposed at the positions interposing the third journal wall 22C.

A gear 34 is integrally provided on the revolving shaft 29 at the position between the aforementioned driven gear 28 and the fourth crank journal wall 22D. The aforementioned gear 34 engages a gear 35 provided at the rear end of the camshaft 32 outwardly of the fourth bearing 33D.

In this manner, power from the crankshaft 21 is transmitted to the camshaft 32 via the drive gear 27, the driven gear 28, the revolving shaft 29, and the gears 34, 35 at a reduction ratio of 1/2.

A sidewall 19*a* projecting downwardly of the aforementioned partition wall 25 is integrally provided on the lower portion of the crankcase 19 along the entire perimeter. An oil pan 37 is connected to the lower end of the aforementioned sidewall 19*a* so as to form an oil trap chamber 36 downwardly of the aforementioned camshaft 32. An oil pump 38, which is a trochoid pump, is stored in the oil pan 37.

A pump housing 39 of the oil pump 38 includes a housing half 40 to be mounted on the oil pan 37 with a housing half 41 to be mounted on the housing half 40. A drive shaft 42 having axis parallel to the crankshaft 21 and the camshaft 32 is rotatably supported by one of the housing half 40. The drive shaft 42 is connected to a rotor 43 to be disposed between both of the housing halves 40, 41.

A gear 44 to be secured on the front end of the crankshaft 21 and a gear 45 to be secured on the aforementioned drive shaft 42 are engaged. Rotational power form the crankshaft 21 is transmitted to the oil pump 38.

An inlet port 46 is formed on the housing half 41 of the pump housing 45 with an oil strainer 47 to be connected to the inlet port 46 being clamped and fixed between the aforementioned housing half 41 and the oil pan 37. The housing half 40 of the pump housing 45 is formed with an outlet port 48 with a relief valve 49 to be connected to the outlet port 48 being clamped and fixed between the housing half 40 and the oil pan 37.

The outlet port 48 of the aforementioned housing half 40 is in communication with an oil path 50 provided on the oil pan 37 with an oil filter 51 (See FIG. 1) to be connected to the oil path 50 being detachably attached to the outer surface of the sidewall of the oil pan 37.

Figure 4:
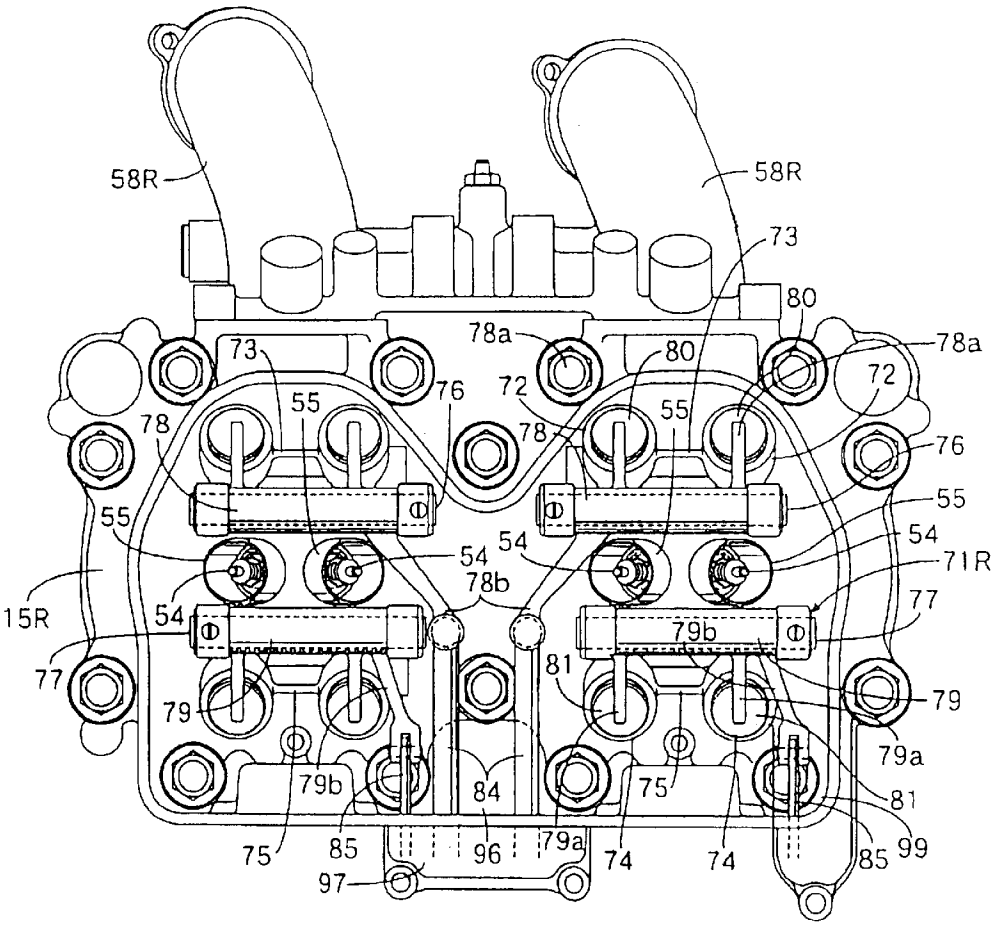
FIG. 4 is a view seen in the direction indicated by the arrows 4—4 in FIG. 1 in a state in which a head cover is removed.
Figure 5:
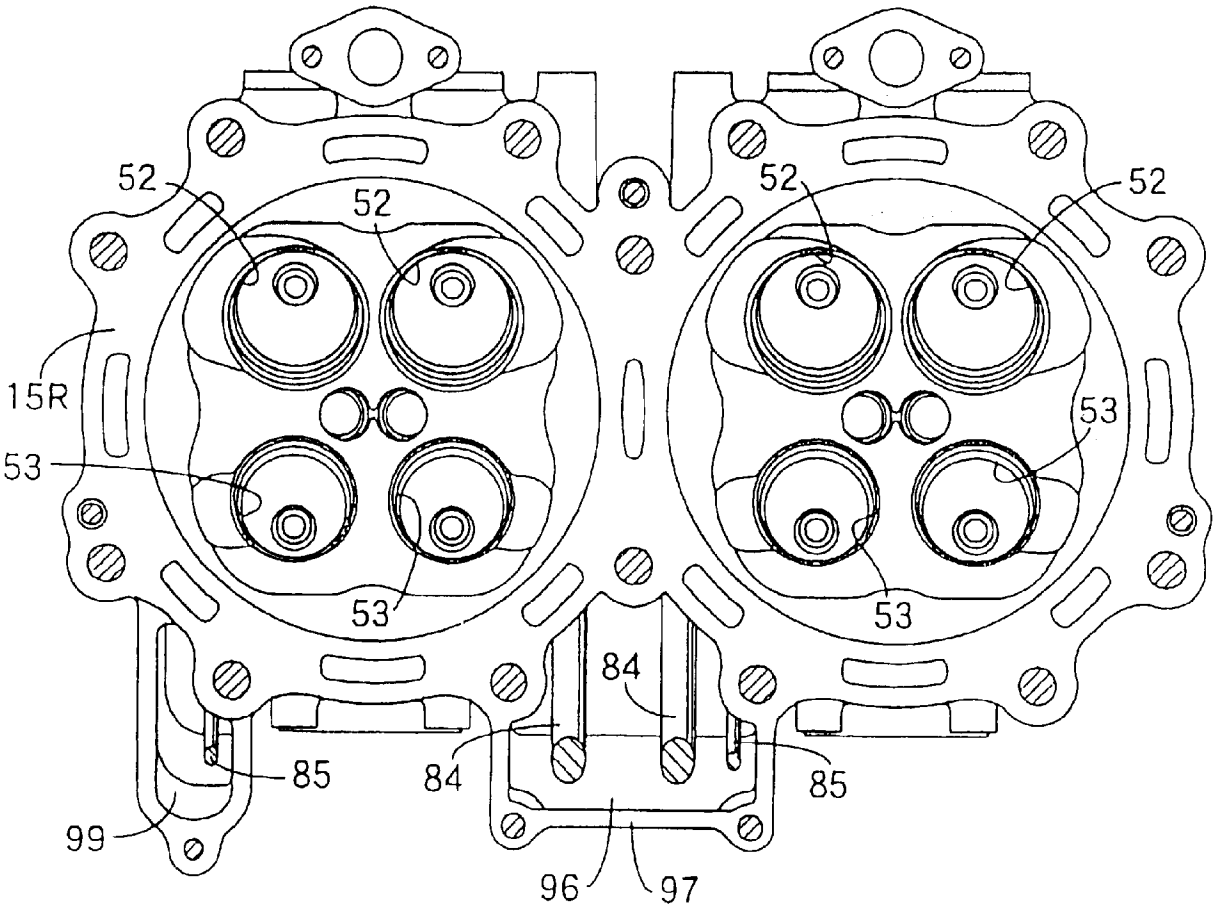
FIG. 5 shows a head cover seen in the direction indicated by the arrows 5—5 in FIG. 1.

Referring also to FIG. 4 and FIG. 5, the cylinder head 15R of the right engine block 12R is provided with a pair of intake valve ports 52, 52, and a pair of exhaust valve ports 53, 53 for every combustion chamber 17R . . . . A pair of ignition plugs 54, 54 is attached to the cylinder head 15R so as to project into the combustion chambers 17R . . . for each combustion chamber 17R. The inner ends of plug insertion cylinders 55, 55 . . . for inserting the respective ignition plugs 54, 54 . . . are fitted and fixed to the cylinder head 15R. These plug insertion cylinders 55, 55 . . . pass through a head cover 68R to be joined to the cylinder head 15R.

The cylinder head 15R is provided with a separate inlet port 56 . . . for each combustion chamber 17R . . . so as to be in communication commonly with a pair of intake valve ports 52, 52 and open through the upper surface of the cylinder head 15R. An exhaust port 57 . . . for each combustion chamber 17R . . . is provided so as to be in communication commonly with a pair of exhaust valve ports 53, 53 and open through the lower surface of the cylinder head 15R.

Inlet pipes 58R . . . in communication with the respective inlet ports 56 . . . are connected to the upper surface of the cylinder head 15R with fuel injection valves 59R . . . being attached on the respective inlet pipes 58R . . . at the portion near the inlet ports 56 . . . .

The intake valve ports 52 . . . are separately openable and closable by intake valves VI . . . urged by a spring force in the valve closing direction with a valve stem 60 of the intake valve VI being slidably fitted to a guide cylinder 61 provided on the cylinder head 15R. The exhaust valve ports 53 . . . are separately openable and closable by exhaust valve VE urged by a spring force in the valve opening direction, and the valve stem 64 of the exhaust valve VE is slidably fitted into the guide cylinder 65 provided on the cylinder head 15R.

The cylinder head 15L of the left engine block 12L is provided with intake valves VI . . . , exhaust valves VE . . . and ignition plugs 54 . . . in pairs for every combustion chamber 17L . . . as the aforementioned right cylinder head 15R with inlet pipes 58L . . . provided with fuel injection valves 59L . . . being connected to the upper surface of the cylinder head 15L. A head cover 68L is joined to the cylinder head 15L.

The intake valves VI . . . and the exhaust valves VE . . . disposed on the right cylinder head 15R in pairs are opened and closed by a valve gear mechanism 71R, and the intake valves VI . . . and the exhaust valves VE . . . disposed on the left cylinder head 15L in pairs are opened and closed by a valve gear mechanism 71L. Since the structures of both of the valve gear mechanisms 71R, 71L are basically the same, the structure of the valve gear mechanism 71R on the right cylinder head 15R will be described below, and description about the structure of the valve gear mechanism 71L on the left cylinder head 15L will be omitted.

The valve gear mechanism 71R includes a pair of intake-side holders 73, 73 having cylindrical lifter housings 72 . . . coaxial with the valve stems 60 . . . of the respective intake valves VI . . . to be mounted on the cylinder head 15R. A pair of exhaust-side holders 75, 75 integrating cylindrical lifter housings 74 . . . coaxial with the valve stems 64 . . . of the respective exhaust valves VE . . . are mounted on the cylinder head 15R. Intake-side and exhaust-side rocker shafts 76 . . . , 77 . . . having axes parallel to each other to be fixed to and supported, respectively, by the aforementioned intake-side and exhaust-side holders 73 . . . , 75 . . . , intake-side rocker arms 78 . . . pivotably supported by the intake-side rocker shafts 76 . . . , exhaust-side rocker arms 79 . . . pivotably supported by the exhaust-side rocker shaft 77, lifters 80 . . . pivotably are fitted to the lifter housings 72 . . . so as to be interposed between the intake-side rocker arms 78 . . . and the intake valves VI, VI . . . . Lifters 81 . . . are pivotably fitted to the lifter housings 74 . . . so as to be interposed between the exhaust-side rocker arms 79 . . . and the exhaust valves VE, VE . . . . The aforementioned camshaft 32 are interlocked and connected to the crankshaft 21 at a reduction ratio of 1/2, intake-side driving arms 82 . . . swinging along with rotation of the camshaft 32, exhaust-side driving arms 83 . . . swinging along with rotation of the camshaft 32. Push rods 84 . . . are provided as connecting rods for interlocking and connecting between the intake-side driving arms 82 . . . and the intake-side rocker arms 78 . . . to provide power in the valve opening direction according to the revolution of the aforementioned camshaft 32 to the intake-side rocker arms 78 . . . . Pull rods 85 . . . are provided as connecting rods for interlocking and connecting between the exhaust-side driving arms 83 . . . and the exhaust-side rocker arms 79 . . . to provide a power in the valve opening direction according to the revolution of the aforementioned camshaft 32 to the exhaust-side rocker arms 79 . . . .

The intake-side and the exhaust-side rocker shafts 76 . . . , 77 . . . are disposed on the cylinder head 15R on both sides of the two pairs of ignition plugs 54, 54. The intake-side rocker shafts 76 . . . are disposed between the intake valves VI, VI or the lifter housings 72, 72 and both ignition plugs 54, 54, respectively with the exhaust-side rocker shafts 77 . . . being disposed between the exhaust valves VE, VE or the lifter housings 73, 73, and the both ignition plugs 54, 54, respectively.

The lifters 80 . . . , 81 . . . are formed into a bottomed cylindrical shape having a diameter larger than the outer diameters of the valve stems 60 . . . of the intake valves VI . . . and the valve stems 64 . . . of the exhaust valves VE, and are slidably fitted to the respective lifter housings 72 . . . , 73 . . . with the closed ends thereof facing towards the aforementioned rocker arms 78 . . . , 79 . . . .

The intake-side rocker arm 78 is integrally provided with a pair of driving arms 78*a* . . . extending towards the aforementioned lifters 80 . . . , and the distal ends of the driving arms 78*a* . . . are capable of exerting a driving force for pressing the intake valves VI, VI in the valve opening direction to the valve stems 60 . . . of the intake valves VI, VI via the aforementioned lifters 80 . . . , and are abutted against the closed end outer surface of the lifters 80 . . . .

The exhaust-side rocker arm 79 is integrally provided with a pair of driving arms 79*a* . . . extending toward the aforementioned lifters 81 . . . , and the distal ends of the driving arms 79*a* . . . are capable of exerting a driving force for pressing the exhaust valves VE, VE in the valve opening direction on the valve stems 64 . . . of the exhaust valve VE, VE via the aforementioned lifters 81 . . . and are abutted against the closed end outer surface the lifters 81 . . . .

Referring again to FIG. 3, the camshaft 32 is provided with a pair of intake-side cams 86 . . . and a pair of exhaust-side cam 87 . . . corresponding to the valve gear mechanism 71R. The pair of intake-side driving arms 82 . . . pivoting along with the respective intake-side cams 86 . . . are disposed on the right side of the camshaft 32 with the exhaust-side driving arms 83 . . . for pivoting along with the respective exhaust-side cams 87 . . . being disposed on the left side of the camshaft 32.

The intake-side driving arms 82 . . . are pivotably supported by a supporting shaft 88 that is fixedly supported by the crankcase 19 on the right side of the camshaft 32 with the exhaust-side driving arms 83 . . . being pivotably supported by a supporting shaft 89 that is fixedly supported by the crankcase 19 on the left side of the camshaft 32.

One of the supporting shafts 88 is disposed on the right side of the camshaft 32 in parallel thereto so as to face both ends thereof towards a sidewall 19*a* of the crankcase 19, and the other supporting shaft 89 is disposed on the left side of the camshaft 32 in parallel thereto so as to face both ends thereof toward a sidewall 19*a* of the crankcase 19.

The aforementioned both supporting shafts 88, 89 are inserted through and supported by a plurality of, for example, seven shaft supporting members 90A–90G, 91A–91G integrated with the partition wall 25 of the crankcase 19 so as to be apart from each other in the direction along the axes thereof.

Figure 6:
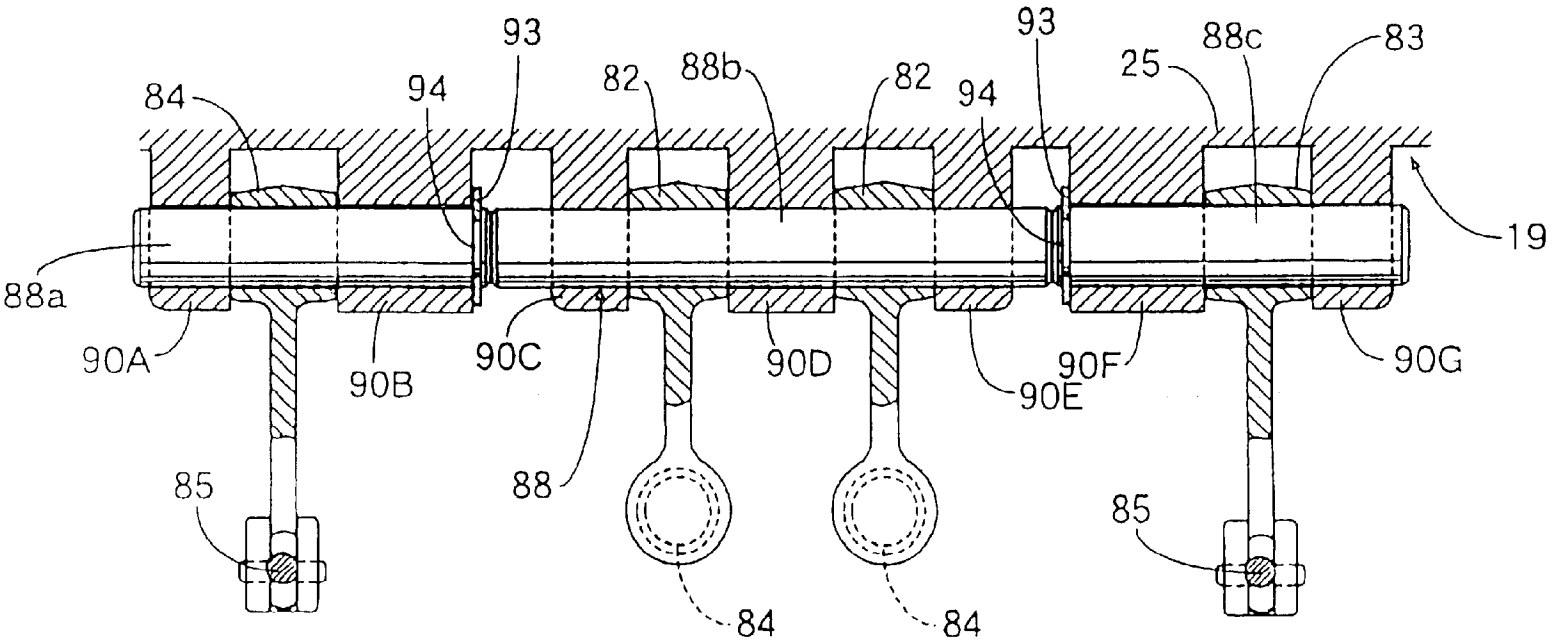
FIG. 6 is an enlarged cross-sectional view taken along the line 6—6 in FIG. 3.

In FIG. 6, the supporting shaft 88 includes shaft sections 88*a*, 88*b*, 88*c* divided into a plurality of, for example, three sections, each inserted into and supported by at least one of the plurality of shaft supporting members 90A–90G and abutted against each other in the axial direction. In other wards, in this embodiment, the shaft section 88*a* is inserted into and supported by the shaft supporting members 90A, 90B, the shaft section 88*b* is inserted into and supported by the shaft supporting members 90C–90E, and the shaft section; 88*c* is inserted into and supported by the shaft supporting members 90F, 90G.

In addition, each divided shaft section 88*a*–88*c* is shorter than the length L1 between at least one (in this embodiment, one) shaft supporting member 90A of the pair of shaft supporting members 90A, 90G facing toward the sidewall 19*a* out of the plurality of aforementioned shaft supporting members 90A–90G and the sidewall 19*a*, and the length L2 of a central shaft section 88*b* which is the longest among the shaft sections 88*a*, 88*b*, 88*c* is set to be shorter than the aforementioned length L1.

The supporting shaft 89 also includes a plurality of shaft sections 89*a*, 89*b*, 89*c* divided into, for example, three sections each inserted into and supported by at least one of the plurality of shaft supporting members 91A–91G and abutting against each other in the axial direction as in the case of the aforementioned supporting shaft 88. In other words, in this embodiment, the shaft section 89*a* is inserted into and supported by the shaft supporting members 91A, 91B, the shaft section 89*b* is inserted into and supported by the shaft supporting members 91C–91E, and the shaft section 89*c* is inserted into and supported by the shaft supporting members 91F, 91G.

In addition, each divided shaft section 89*a*-89*c* is shorter than the length L3 between at least one (in this embodiment, one) shaft supporting member 91G of the pair of shaft supporting members 91A, 91G facing towards the sidewall 19*a* out of the plurality of aforementioned shaft supporting members 91A–91G and the sidewall 19*a*, and the, length L4 of a central shaft section 89*b* which is the longest among the shaft sections 89*a*, 89*b*, 89*c* is set to be shorter than the aforementioned length L3.

As shown clearly in FIG. 6, the outer peripheries of the shaft sections 88*a*, 88*c* located at both ends out of the plurality of the aforementioned shaft sections 88*a*–88*c* are formed with annular mounting grooves 94, 94, respectively, and retaining rings 93, 93 as movement prevention members to engage one of the shaft supporting members 90A, 90B and 90F, 90G, wherein the shaft sections 88*a*, 88*c* at both ends are inserted into and supported by the shaft supporting members 90B, 90F in this embodiment, and are detachably mounted on the aforementioned mounting grooves 94, 94, respectively. The retaining rings 93, 93 engage the shaft supporting members 90B, 90F from axially inside, respectively, whereby axially outward movement of said shaft sections 88*a*, 88*c* at both ends may be prevented.

In addition, on the outer peripheries of the shaft sections 89*a*, 89*c* located at both ends out of the plurality of the aforementioned shaft sections 89*a*–89*c*, the retaining rings 93, 93, as movement prevention members, are provided to axially inwardly engage one of the shaft supporting members 91A, 91B and 91F, 91G, wherein the shaft sections 89*a*, 89*c* at both ends are inserted into and supported by the shaft supporting members 91B, 91F in this embodiment that are detachably mounted, whereby axially outward movement of said shaft sections 88*a*, 88*c* at both ends may be prevented.

Focusing again on FIG. 4, a pair of intake-side rocker arms 78,78 are capable of pivotal movement about the identical axis are provided, respectively, with input arms 78*b*, 78*b* at the adjacent ends thereof so as to extend towards the camshaft 32 (downwardly in FIG. 4). The pair of exhaust-side rocker arms 79, 79 are capable of pivotal movement about the identical axis and are provided, respectively, with input arms 79*b*, 79*b* at one of the axial ends (in this embodiment, the front ends) so as to extend towards the camshaft 32 (downward in FIG. 4).

The input arms 78*b*, 78*b* of the intake-side rocker arms 78, 78 and the intake-side driving arms 82, 82 are connected by the push rods 84, 84, and the input arms 79*b*, 79*b* of the exhaust-side rocker arms 79, 79 and the exhaust-side driving arms 83, 83 are connected by the pull rods 85, 85.

The push rod 84 pushes the input arm 78*b* to allow pivotal movement of the intake-side rocker arm 78 in the valve opening direction when the push rod 84 moves towards the side opposite from the camshaft 32. Both ends of the push rod 84 formed into spherical shape are swingably received by the input arm 78*b* of the intake-side rocker arm 78 and the intake-side driving arm 82. The pull rod 85 pulls the input arm 79*b* to allow pivotal movement of the exhaust-side rocker arm 79 in the valve opening direction when the pull rod 85 is moved towards the camshaft 32. Both ends of the pull rod 85 are rotatably connected to the input arm 79*b* of the exhaust-side rocker arm 79 and the exhaust-side driving arm 83. In addition, since the tensile strength of material forming both of the push rod 84 and the pull rod 85 is higher than the compressive strength, the pull rod 85 is formed to have a smaller diameter than the push rod 84.

By arranging the input arms 78*b*, 78*b* of intake-side rocker arms 78, 78 and the input arms 79*b*, 79*b* of the exhaust-side rocker arms 79, 79 as described above, three rods, or a pair of push rods 84, 84 and one of the pull rods 85 out of the pairs of push rods 84, 84, and pull rods 85, 85, are disposed between cylinder axes CR, CR of the adjacent cylinder bores 16R, 16R in the cylinder block 13R, and a remaining pull rod 85 is disposed outwardly of the cylinder axis CR of the outermost cylinder bore 16R along the axis of the crankshaft 21.

The aforementioned pair of push rods 84, 84 and one of the pull rods 85 are stored in a rod storage chamber 96 provided over the cylinder head 15R, the cylinder block 13R and the crankcase 19 between the adjacent cylinder bores 16R, 16R of the cylinder block 13R, and the rod storage chamber 96 is formed by a bulged portion 97 formed by bulging a part of the cylinder head 15R, the cylinder block 13R and the crankcase 19 outward.

On the other hand, the remaining pull rod 85 is stored in part within a pipe member 98 disposed away from the outer wall of the cylinder block 13R. In addition, both ends of the pipe member 98 are, as clearly shown on the part of the valve gear mechanism 71L on the left side in FIG. 1, fitted and connected to a first communication chamber 99 formed from the cylinder head 15R to the upper portion of the cylinder block 13R, and to a second communication chamber 100 formed in the crankcase 19 being integral with the cylinder block 13R.

Figure 7:
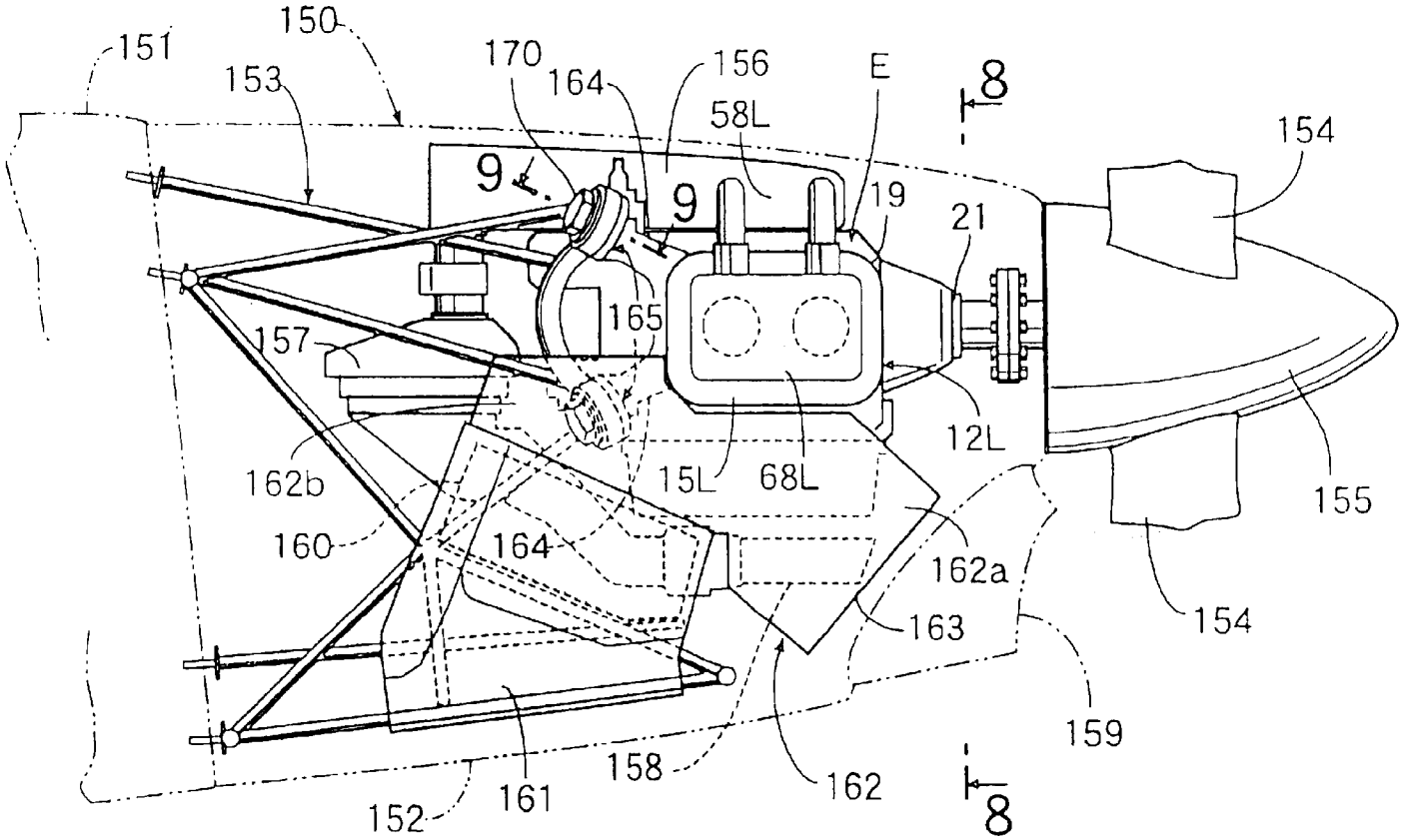
FIG. 7 is a side view of the engine in a state of being mounted on the aircraft.

When such engine E is mounted on an aircraft 150 as shown in FIG. 7, the engine E is stored in a cowl 152 to be mounted on the front of a fuselage 151 in such a manner that the axis of the crankshaft 21 is laid along the fore-and-aft direction, and is resiliently supported by a supporting frame 153 disposed in the cowl 152.

A spinner 155 having a plurality of propeller blades 154 . . . is disposed forwardly of the cowl 152, and the crankshaft 21 of the engine E is coaxially connected to the spinner 155.

Figure 8:
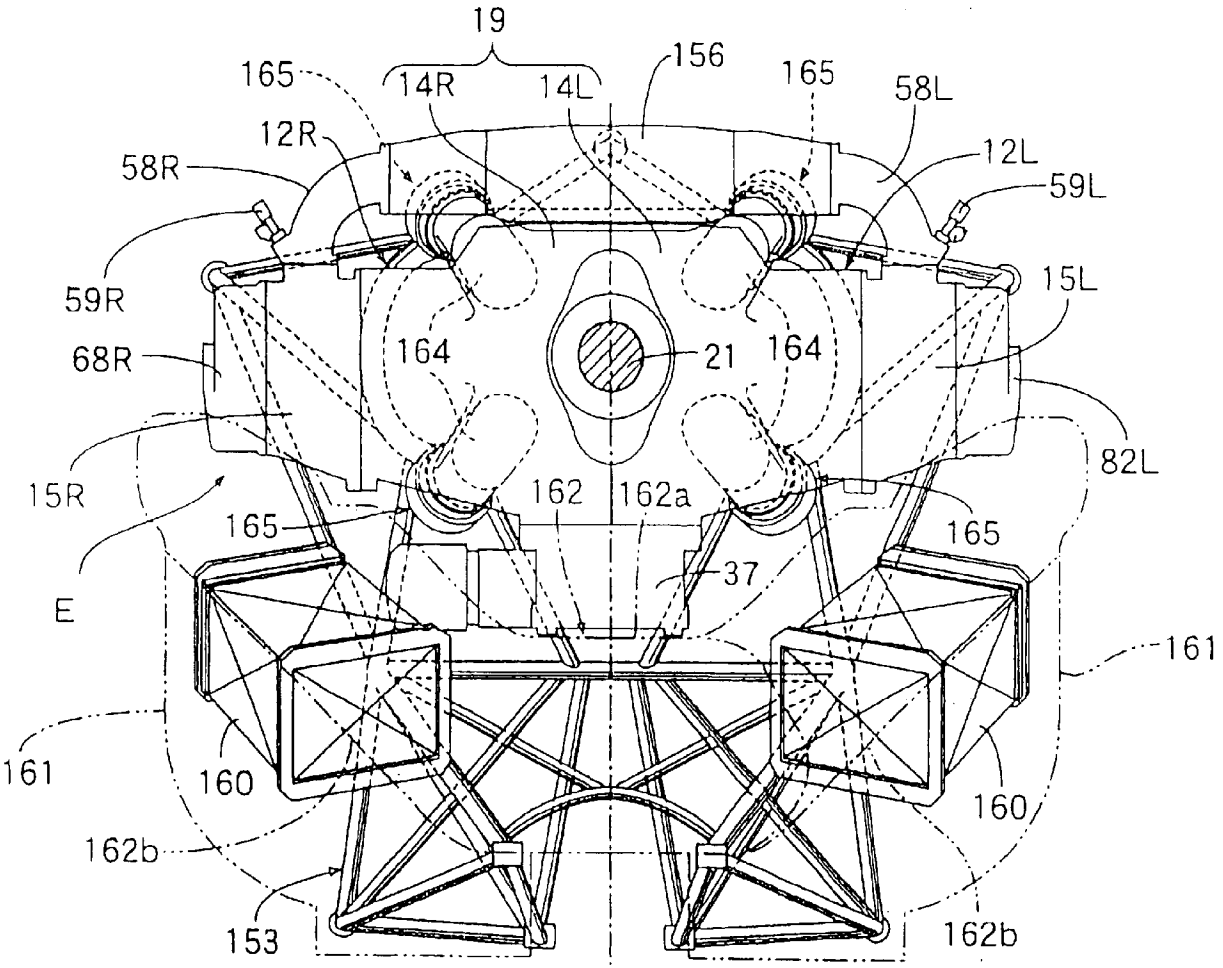
FIG. 8 is an enlarged cross-sectional view taken along the line 8—8 in FIG. 7.

Referring also to FIG. 8, an intake manifold 156 extending in the fore-and-aft direction is disposed upwardly of the engine E, and the intake pipes 58L . . . , 58R . . . in communication with the intake ports 56 . . . of the cylinder heads 15L, 15R in the left and right cylinder blocks 12L, 12R of the engine E are connected to both sides of the front portion of the intake manifold 156.

An air cleaner 157 to be disposed rearwardly of the engine E and downwardly of the rear portion of the aforementioned intake manifold 156 is connected to the rear portion of the intake manifold 156. Further, a suction pipe 158 extending under the engine E towards the front is connected to the lower portion of the air cleaner 157, and the front end of the suction pipe 158 opens towards a screen 159 provided at the lower portion of the front end of the cowl 152.

Radiators 160, 160 are disposed on the left and right sides of the lower portion of the engine E. The radiators 160, 160 are stored in a pair of first air ducts 161, 161 extending with its head up, and the lower ends of the first air ducts 161, 161 open obliquely towards the rear in the cowl 152. A second air duct 162 is commonly connected to the upper ends of the first air ducts 161, 161. The second air duct 162 includes a common duct member 162*a* having an air intake port 163 at the center of the front end so as to face towards the aforementioned screen 159 and laterally extending under the front portion of the engine E, and a pair of branch duct members 162*b*, 162*b* extending upwardly and rearwardly from the left and right ends of the common duct member 162*a* and connected to the upper ends of the aforementioned first air ducts 161, 161.

In other words, the radiators 160, 160 disposed on the left and right sides of the lower portion of the engine E are cooled by air pumped from the propeller blades 154 . . . entering from the screen 159 at the front end of the cowl 152 into the air intake port 163 and branched from the second air duct 162 into the left and right first air ducts 161, 161.

The supporting frame 153 is formed, for example, in such a manner that a plurality of pipe members are assembled so as to embrace from behind the aforementioned engine E. On the other hand, mounting arms 164, 164 . . . are mounted at a slant, for example, at four locations on the rear of the crankcase 19 of the engine E in such a manner that the distance with each other increases as it extends towards the rear, in such a manner that they are positioned at the corners of a virtual right angled square centered to the axis on the plane orthogonal to the axis of the crankshaft 21, and the mounting arms 164, 164 . . . are attached on the supporting frame 153 via resilient mounts 165, 165 . . . .

Figure 9:
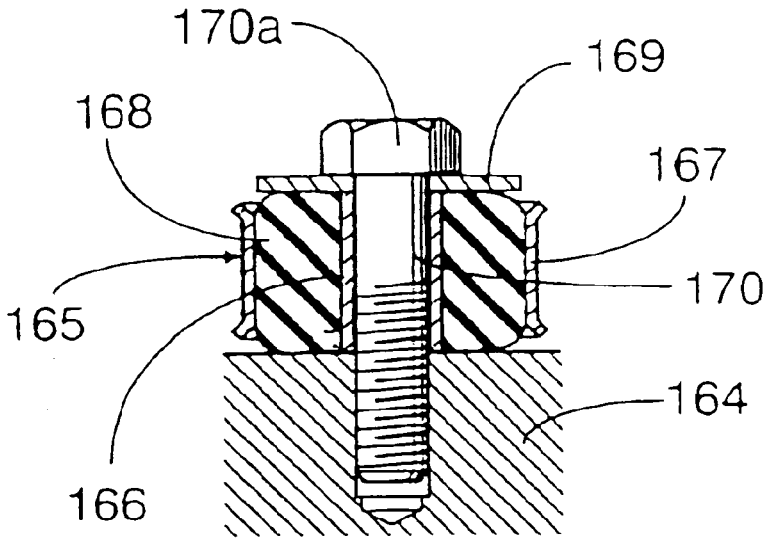
FIG. 9 is an enlarged cross-sectional view taken along the line 9—9 in FIG. 8.

Referring also to FIG. 9, the resilient mount 165 includes a cylindrical collar 166, a cylindrical supporting tube 167 coaxially surrounding the collar 166 and being adhered on the supporting frame 153, and a mount rubber 168 being interposed between the collar 166 and the supporting cylinder 167 by baking the inner and outer periphery on the outer periphery of the collar 166 and the inner periphery of the supporting cylinder 167, and both ends of the color 166 project from both ends of the supporting cylinder 167.

A holding plate 169 abuts against one end of the collar 166, which abuts against the mounting arm 164 at the other end. Then a bolt 170 having an enlarged head 170*a* for engaging the outer surface of the holding plate 169 and being inserted into the holding plate 169 and the collar 166 are screwed into the mounting arm 164 of the engine E. By fastening the bolt 170, the mounting arm 164, or the engine E, is resiliently mounted on the supporting frame 153.

The operation of the present embodiment will be described. In the valve gear mechanisms 71R, 71L, three rods, or a pair of push rods 84, 84 and one of the pull rods 85 out of the pair of push rods 84, 84, and the pull rods 85, 85, are stored in the rod storage chambers 96 . . . provided over the cylinder heads 15R, 15L, the cylinder blocks 13R, 13L and the crankcase 19 between the cylinder axes CR, CR; CL, CL of the adjacent cylinder bores 16R, 16R; 16L, 16L in the respective cylinder blocks 13R, 13L with a remaining pull rod 85 is disposed outwardly of the cylinder axis CR of the outermost cylinder bore 16R along the axis of the crankshaft 21. The aforementioned pull rod 85 is stored in part/in the pipe members 98 . . . disposed at a position away from the outer walls of the cylinder blocks 13L, 13R.

Therefore, since as many of the push rods 84, 84 and the pull rod 85 as can reasonably be accommodated between the cylinder axes CR, CR; CL, CL of the adjacent cylinder bores 16R, 16R; 16L, 16L in both cylinder blocks 13R, 13L are stored in the rod storage chambers 96 . . . provided in both cylinder heads 15R, 15L, both cylinder blocks 13R, 13L and the crankcase 19, and a pull rod 85, which is a remaining rod, is stored in part in the pipe members 98 . . . Thus, it is possible not only to reduce the number of pipe members 98 as much as possible, and thus the number of components, but also to reduce the number of steps of assembly of the pipe member 98. In addition, the distances between the adjacent cylinder bores 16R, 16R; 16L, 16L are reduced to a reasonable extent to contributes to the downsizing of the engine E.

Both ends of the pipe member 98 are connected to the first communication chamber 99 formed from the cylinder heads 15R, 15L to the upper portion of the cylinder blocks 13R, 13L, and to the second communication chamber 100 formed in the crankcase 19 being integral with the aforementioned cylinder blocks 13R, 13L. Therefore, both ends of the pipe member 98 are connected to the upper portion of the cylinder block 13R, 13L and to the crankcase 19 at a position that is not varied by the assembling error of the crankcase 19, the cylinder blocks 13R, 13L, and the cylinder heads 15R, 15L. Thus, the pipe member 98 is prevented from being stressed by an assembling error and the seal at both ends of the pipe member 98 is prevented from being impaired by the stress.

In the valve gear mechanisms 71R, 71L, the supporting shafts 88, 89 for pivotably supporting the intake-side driving arms 82 . . . and the exhaust-side driving arms 83 . . . , are inserted into and supported by a plurality of shaft supporting members 90A–90G, 91A–91G provided on the partition wall 25 of the crankcase 19, include a plurality of shaft sections 88*a*–88*c*; 89*a*–89*c* that are divided into sections shorter than the distance L1 , L3 between at least one (in this embodiment, one) 90A, 91G of the pairs of shaft supporting members 90A, 90G; 91A, 91G facing towards the sidewall 19*a* of the crankcase 19 out of the shaft supporting members 90A–90G, 91A–91G, and the aforementioned sidewall 19*a* axially abutting with each other. The respective shaft sections 88*a*–88*c*; 89*a*–89*c* are inserted into and supported by at least one of the aforementioned plurality of shaft supporting members 90A–90G, 91A–91G.

In this arrangement, a plurality of shaft sections 88*a*–88*c*; 89*a*–89*c* may be inserted into the shaft supporting members 90A–90G, 91A–91G respectively in sequence without forming an opening on the sidewall 19*a* of the crankcase 19 facing towards both ends of the supporting shafts 88, 89. Thus, the supporting shafts 88, 89 may be constructed by axially abutting the respective shaft sections 88*a*–88*c*; 89*a*–89*c* with each other. Therefore, it is not necessary to employ a structure in which the respective shaft supporting members 90A–90G, 91A–91G are divided into the upper portions and the lower portions. Thus, an increase in the cost may be avoided. In addition, it is not necessary to form an opening on the sidewall 19*a*. Thus, a member for closing the opening is not necessary and the number of components and the number of assembling steps may be reduced correspondingly when the supporting shafts 88, 89 are mounted on the crankcase 19 of the engine body 11.

Since the shaft sections 88*a*, 88*c*; 89*a*, 89*c* located at both ends out of the aforementioned plurality of shaft sections 88*a*–88*c*; 89*a*–89*c* are fitted with the retaining rings 93 . . . for engaging the shaft supporting members 90B, 90F, 91B, 91F for inserting and supporting the shaft sections 88*a*, 88*c*; 89*a*, 89*c* located at both ends and preventing axially outward movement of the aforementioned shaft sections 88*a*, 88*c*; 89*a*, 89*c* at both ends, the coaxial connecting structure of all the shaft sections 88*a*–88*c*; 89*a*–89*c* may be maintained only by attaching the retaining rings 93 . . . on the pair of shaft sections 88*a*, 88*c*; 89*a*, 89*c*, whereby the number of components for fixedly supporting the supporting shafts 88, 89 to the crankcase 19 may be reduced.

In addition, since the axially outward movement of the shaft sections 88*a*, 88*c*; 89*a*, 89*c* is prevented by the retaining ring 93, the structures of the shaft supporting members 90B, 90F, 91B, 91F are simplified, and the machining operation to be applied on the shaft sections 88*a*, 88*c*; 89*a*, 89*c* may be facilitated.

Though an embodiment of the present invention has been described thus far, the present invention is not limited thereto, and various modification may be made without departing the scope of the present invention.

For example, though the OHV engine to be mounted on the aircraft has been described in the embodiment described above, it is also possible to implement the present invention in relation to the OHV engine to be mounted on the motorvehicle and the motorcycle. Further, it is not limited to the horizontal opposed engine, and the present invention may be implemented in relation to a V-type engine.

As is described thus far, according to the present invention, the number of the pipe members may be reduced as much as possible to reduce the number of components as well as the number of assembling steps of the pipe members. In addition, the distance between the adjacent cylinder bores may be reduced to a reasonable extent, which may contribute to downsizing of the engine.

According to the present invention, the pipe member is prevented from being stressed by the assembling error, and sealing on both ends of the pipe member is prevented from being impaired by the stress.

In addition, for example, in the aforementioned embodiment, the present invention is applied to the supporting shafts 88, 89 for supporting the intake-side and the exhaust-side driving arms 82, 83 that are interlocked with and connected to the push rod 84 and the pull rod 85, respectively. However, it is also possible to apply the present invention to the rocker shaft for supporting the rocker arm in the valve gear mechanism having a rocker arm interposed between the intake valve and the exhaust valve.

Furthermore, the present invention may be embodied in conjunction with a valve gear mechanism of the engine to be mounted on a motor vehicle and a motorcycle in addition to the valve gear mechanism for an engine to be mounted on the aircraft.

As is described above the present invention provides a supporting shaft that may be mounted in the engine body while avoiding an increase in the costs and reducing the number of the components and of the assembling steps.

According to the present invention, the number of components for fixedly supporting the supporting shaft on the engine body may be reduced.

According to the present invention, the structure of the shaft supporting member may be simplified, and the machining operation applied on the shaft sections may be facilitated.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An OHV engine including a pair of cylinder blocks each having a plurality of cylinder bores connected to a crankcase with cylinder axes (CL, CR) of said cylinder bores being displaced in a direction along an axis of the crankshaft and connecting rods for transmitting power from cams provided on a camshaft interlocked with and connected to said crankshaft and stored in the crankcase are individually interlocked with and connected to a pluralities of rocker arms pivotably supported, respectively, by the cylinder heads connected respectively to both of the cylinder blocks comprising:

a part of the connecting rods out of said respective connecting rods are stored in a rod storage chamber provided, respectively, in both cylinder heads, both cylinder blocks and the crankcase between the cylinder axes (CL, CR) of the adjacent cylinder bores in said respective cylinder blocks; and a remaining connecting rod disposed outwardly of the cylinder axes (CL, CR) of the outermost cylinder bores is laid along the axis of said crankshaft and stored in part in the pipe member disposed at the position away from the outer wall of said cylinder blocks.

2. The OHV engine according to claim 1, wherein both ends of the pipe member for storing said remaining connecting rod in part are connected to a first communication chamber formed from the cylinder heads to the upper portion of the cylinder blocks and to a second communication chamber formed in the crankcase which is integrally formed with said cylinder blocks.

3. The OHV engine according to claim 1, wherein the part of the connecting rods includes a first plurality of connecting rods extending substantially in parallel with a first cylinder bore and being offset a predetermined distance therefrom.

4. The OHV engine according to claim 3, wherein the part of the connecting rods includes a second plurality of connecting rods extending substantially in parallel with a second cylinder bore and being displaced a predetermined distance from said first plurality of connecting rods and being offset a predetermined distance from said second cylinder bore.

5. The OHV engine according to claim 1, wherein the remaining connecting rod extends substantially in parallel with a first cylinder bore and being offset a predetermined distance therefrom.

6. An OHV engine including a cam provided on the camshaft interlocked with and connected to the crankshaft and stored in the crankcase and a plurality of rocker arm pivotably supported by the cylinder heads being interlocked and connected with each other via the connecting rod, a connecting rod is stored in part in a pipe member disposed between said crankcase and the cylinder heads at a position away from an outer wall of cylinder blocks, the pipe member having one end connected to a first communication chamber formed from the cylinder heads to the upper portion of cylinder blocks and having a second end connected to the second communication chamber formed in the crankcase that is formed integrally with said cylinder blocks, wherein the connecting rod extends from one side of the cam shaft to one of the rocker arms on an opposite side of the cam shaft,thereby crossing over the cam shaft.

7. The OHV engine according to claim 6, wherein a first plurality of connecting rods extend substantially in parallel with a first cylinder bore and being offset a predetermined distance therefrom.

8. The OHV engine according to claim 7, wherein a second plurality of connecting rods extend substantially in parallel with the a second cylinder bore and are displaced a predetermined distance from said first plurality of connecting rods and being offset a predetermined distance from said second cylinder bore.

9. An OHV engine according to claim 6, wherein the cylinder blocks each have a plurality of cylinder bores connected to the crankcase with cylinder axes (CL, CR) of said cylinder bores being displaced in a direction along an axis of the crankshaft, the connecting rod being a plurality of connecting rods for transmitting power from the cams, wherein a part of the plurality of connecting rods are individually interlocked with and connected to the plurality of rocker arms pivotably supported, respectively, by the cylinder heads connected respectively to the cylinder blocks, and are stored in a rod storage chamber provided, respectively, in the cylinder heads, the cylinder blocks and the crankcase between the cylinder axes (CL, CR) of the adjacent cylinder bores in said respective cylinder blocks; and wherein a remaining one of the plurality of connecting rods disposed outwardly of the cylinder axes (CL, CR) of outermost cylinder bores is laid along the axis of said crankshaft and is stored in part in the pipe member disposed at a position away from the outer wall of said cylinder blocks.

10. The OHV engine according to claim 9, wherein both ends of the pipe member for storing said remaining connecting rod in part are connected to a first communication chamber formed from the cylinder heads to the upper portion of the cylinder blocks and to a second communication chamber formed in the crankcase which is integrally formed with said cylinder blocks.

11. The OHV engine according to claim 9, wherein the remaining connecting rod extends substantially in parallel with a first cylinder bore and being offset a predetermined distance therefrom.

12. An OHV engine including, cams provided on a camshaft interlocked with and connected to a crankshaft and stored in a crankcase and a plurality of rocker arms pivotably supported by cylinder heads being interlocked and connected with each other via a connecting rod, wherein the connecting rod is stored in part in a pipe member disposed between said crankcase and the cylinder heads at a position away from an outer wall of cylinder blocks and one end of the pipe member is connected to a first communication chamber formed from the cylinder heads to upper portion of cylinder blocks, and an opposite end of the pipe member is connected to a second communication chamber formed in the crankcase that is formed integrally with said cylinder blocks, wherein the cylinder blocks each have a plurality of cylinder bores connected to the crankcase with cylinder axes (CL, CR) of said cylinder bores being displaced in a direction along an axis of the crankshaft, the connecting rod being a plurality of connecting rods for transmitting power from the cams, wherein a part of the plurality of connecting rods are individually interlocked with and connected to the plurality of rocker arms pivotably supported, respectively, by the cylinder heads connected respectively to the cylinder blocks, and are stored in a rod storage chamber provided, respectively, in the cylinder heads, the cylinder blocks and the crankcase between the cylinder axes (CL, CR) of the adjacent cylinder bores in said respective cylinder blocks; and wherein a remaining one of the plurality of connecting rods disposed outwardly of the cylinder axes (CL, CR) of outermost cylinder bores is laid along the axis of said crankshaft and is stored in part in the pipe member disposed at a position away from the outer wall of said cylinder blocks.

* * * * *